United States Patent [19]

Ollinger

[11] 4,068,444

[45] Jan. 17, 1978

[54] CEILING RUNNER WITH CLOSURE STRIP

[75] Inventor: James C. Ollinger, Lancaster, Pa.

[73] Assignee: Armstrong Cork Company, Lancaster, Pa.

[21] Appl. No.: 792,897

[22] Filed: May 2, 1977

[51] Int. Cl.[2] ..... E04C 3/32

[52] U.S. Cl. ..... 52/731

[58] Field of Search ..... 52/730–732, 52/488, 498, 495, 461, 664–668, 484; 403/230

[56] References Cited

U.S. PATENT DOCUMENTS

| | | | |
|---|---|---|---|
| 1,074,895 | 10/1913 | Rapp | 52/461 |
| 3,016,997 | 1/1962 | Price | 52/668 |
| 3,067,323 | 12/1962 | Kember | 52/484 |
| 3,599,386 | 8/1971 | LaLonde | 52/731 |
| 3,633,952 | 7/1970 | Nikolaus | 403/230 |
| 3,798,865 | 3/1974 | Curtis | 52/665 |
| 3,835,614 | 9/1974 | Downing | 52/666 |

FOREIGN PATENT DOCUMENTS

| | | | |
|---|---|---|---|
| 736,145 | 6/1966 | Canada | 52/495 |
| 65,636 | 10/1955 | France | 52/495 |
| 403,258 | 7/1966 | Switzerland | 52/498 |
| 751,538 | 6/1956 | United Kingdom | 52/732 |

*Primary Examiner*—Price C. Faw, Jr.
*Assistant Examiner*—James L. Ridgill, Jr.

[57] ABSTRACT

The invention is directed to a ceiling runner which has a generally U-shaped configuration. The runner has flanges to support ceiling boards. The side walls of the runner are formed with first grooves which may be used to support the runner in position or define an isolation chamber within the body of the runner. The side walls of the runner have second grooves which are used for positioning ceiling boards on the flanges. A closure member is used in combination with this ceiling runner to close off either the bottom of the runner or the top of the runner.

6 Claims, 5 Drawing Figures

CEILING RUNNER WITH CLOSURE STRIP

CROSS-REFERENCE TO RELATED APPLICATION

This application is an addition to the ceiling runner set forth in U.S. application Ser. No. 780,418, filed Mar. 23, 1977 in the name of Ernest B. Nute, Jr., and entitled CEILING RUNNER.

FIELD OF THE INVENTION

The invention is directed to a suspended ceiling system and, more particularly, to a runner member of a specific configuration for use in the suspended ceiling system and a closure member for use with said runner member.

DESCRIPTION OF THE PRIOR ART

U.S. Pat. No. 2,447,694 is directed to a runner structure having a configuration somewhat similar to that of the claimed invention. The runner structure therein is not an exposed grid member in that it cannot be viewed from below a suspended ceiling system, and it functions primarily as a fastening means for another runner in a concealed grid system suspended ceiling.

U.S. Pat. No. 3,067,323 is directed to another runner structure which has cross-sectional configurations somewhat like the claimed invention. Again, the patented structure differs from the claimed invention primarily in the fact that the patented structure is not formed to be mounted as per the claimed invention and that the patented structure does not have flanges for supporting a ceiling system.

U.S. Pat. No. 3,708,932 is directed to a grid member having a structure slightly similar to the claimed invention. The primary difference between the patented structure and the claimed invention is the positioning of the groove structure in the side walls of the runner member.

Finally, U.S. Pat. No. 3,685,235 is directed to a grid member having a structure slightly similar to that of the claimed runner. In FIG. 4 of that patent, there is shown a closure strip which is designed to be inserted within the body of the grid member.

SUMMARY OF THE INVENTION

The invention herein is a ceiling runner and closure strip which is to be used in a suspended ceiling system. The runner is of a generally elongated inverted U-shaped configuration. The runner has two partly inclined side walls which are connected together by a flat top member. The runner has horizontal flanges which are used to support ceiling boards. The side walls of the runner have a first groove means therein, and said groove means extend outwardly from the side wall to form two parallel ledges in the sides of the U-shaped body configuration of the runner. The grooves are positioned about midway of the side walls of the runner. A second groove means is provided in the side walls closely adjacent the horizontal flanges. A closure strip is used in conjunction with the ceiling runner. The closure strip has a flat elongated body portion and flanges on the sides of the body portion. The flanges are in the form of two off-set leg means positioned on one side of the plane containing the body portion. The closure strip is sized to have its flanges positioned within the second groove means so that the closure strip closes off the bottom of the ceiling runner. The closure strip can be mounted in the second groove means in either one of two positions so as to form a flush closure or a recessed closure for the ceiling runner. The closure strip is also sized so that it will set on top of the flat top member of the runner member and extend partly over the two partly inclined side walls to close off any ventilating apertures which may be positioned in the flat top member of the ceiling runner.

DESCRIPTION OF THE PREFERRED EMBODIMENT

Figure 5:
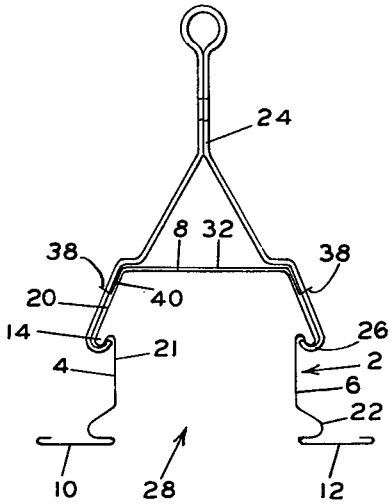
FIG. 5 is an end view of a ceiling runner containing the closure strip in its third operative position.

The sheet metal elongated runner structure 2 herein has generally the cross-sectional configuration shown in FIG. 5. The cross-sectional configuration is generally an inverted "U" shape with side walls 4 and 6. The side walls 4 and 6 are connected together by flat top member 8. Horizontal flanges 10 and 12 extend outwardly from the runner member 2 at the lower ends of the side walls 4 and 6. It is on these flanges 10 and 12 that ceiling boards will be supported. Runner members 2 are arranged in a grid pattern so as to support ceiling boards on the flanges 10 and 12 within the grid pattern.

Each of the side walls has a groove 14 therein at the mid region thereof. The grooves in effect form an overhang portion 20 which hangs over another portion 21 of the side wall. In effect, side wall 4 is composed of an inclined overhang portion 20 and a vertical portion 21 which are connected together by the groove 14. Groove 14 functions as a fastening point for a hanger 24 which has hooked ends 26 which grasp around the outside of the groove 14 to suspend the runner 2 in position from the structural ceiling of a room. The runner 2 is provided with an open bottom 28. A second groove means 22 is provided in the lower portion 21 of the side walls 4 and 6. This groove faces inwardly of the U-shaped configuration and forms a projection which extends outwardly from the lower portion of the side walls closely adjacent the flanges 10 and 12. This functions as a projection which positions ceiling boards resting upon the flanges 10 and 12.

Figure 3:
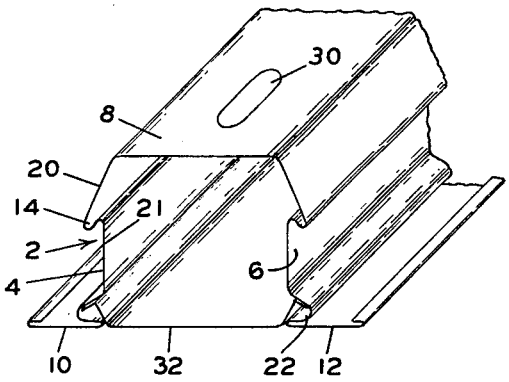
FIG. 3 is a perspective view of the ceiling runner containing the closure strip in its first operative position.

The runners of a normal suspended ceiling system may function only to support ceiling boards in position. However, sometimes the runners are used as the means for bringing into or conveying from a room the ventilating air or heating and cooling air which is used to secure the proper environmental conditions in the room having the suspended ceiling. Consequently, as shown in FIG. 3, the runner 2 may be provided with a series of apertures 30 in its top wall 8 to permit the flow of conditioned air through the runner structure. The open bottom 28 and the apertures 30 provide for a passageway whereby air may pass through the runner 2.

Figure 1:
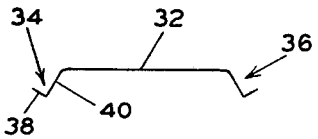
FIG. 1 is an end view of the closure strip.
Figure 2:
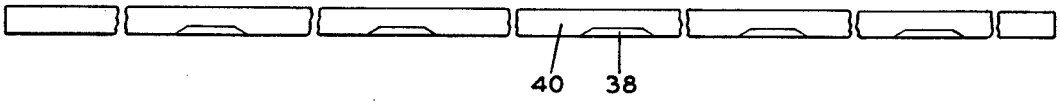
FIG. 2 is a side view of the closure strip.

FIGS. 1 and 2 are views of the side and end of a closure strip which may be used to close off the openings 28 and 30. The closure strip has a body portion 32 which is elongated in structure. On each side of the elongated body portion 32 there is positioned flanges 34 and 36. Both flanges are positioned on the same side of the plane containing the body portion 32. The flanges are composed of two offset leg means 38 and 40. Leg 40 is inclined outwardly from the body portion 32 at an obtuse angle of approximately 115°. The second leg 38 is really a series of tabs, as best seen in FIG. 2. These extend at right angles from the leg 40. It would thus appear that the body portion 32 has a series of L-shaped flanges extending outwardly from the ends of the body portion and on one side of the plane containing the body portion 32.

The body portion 32 is made so that it is the same width as the spacing between the sides 4 and 6 and, specifically, the spacing between the portions 21 of the sides 4 and 6. Therefore, the closure strip may be inserted into the above-described runner in the manner shown in either FIGS. 3 and 4. The closure strip is inserted into the second groove means 22. Referring now to FIG. 3, the closure strip is in its flush position wherein the flanges 10 and 12 are in the same plane as the body portion 32 of the closure strip. This causes the closure strip to appear to be part of a conventional suspended ceiling flange structure in that the elements 10, 32 and 12 appear to be one continuous piece. The leg portions 34 and 36 extend into the second groove means 22 and the inclination of the offset leg 40 resting against the lower edge of the second groove means 22 holds the closure strip in position.

Figure 4:
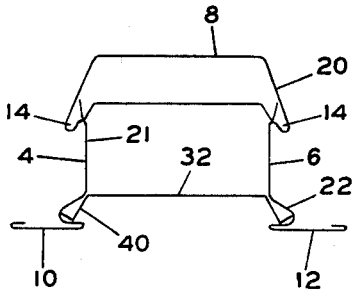
FIG. 4 is an end view of a ceiling runner containing the closure strip in its second operative position.

FIG. 4 is a view of the closure strip being held in the second groove means 22, but with the closure strip being turned 180°. The body portion 32 is now recessed partly into the area between the side walls 4 and 6 and thus provides a recessed effect for the closure strip. Now the body of the closure strip is not in the same plane containing flanges 10 and 12. Again, the flange portions 34 and 36 extend into the second groove means 22 and now the leg portions 40 not only support the closure strip in position since the legs are resting against the lower portion of the groove means 22, the legs 40 also form the side walls of the recessed area. The runner now appears to have a flange composed of the flanges 10 and 12 with a recessed center area composed of legs 40 and body portion 32. In effect, what is formed is simply a shallower version of the runner structure used alone without the closure strip.

Finally, FIG. 5 is a showing of the third use of the closure strip. The angle that the leg 40 extends from the body portion 32 is the same angle that the top wall 8 and side wall portion 20 extend relative to each other. Therefore, the closure member may be placed on top of the runner, and the body portion 32 is the same width as the top wall 8 of the runner. The legs 40 then extend partly down the side wall portion 20, and the closure strip is held in position by the hanger means 24 which may have its legs slipped in between the tab portions 38. The closure strip is now functioning to close off the openings 30, whereas the closure strip of FIGS. 3 and 4 were closing off the opening 28.

It should be noted that the closure strip herein could have a fourth function, as shown in FIG. 4. Here, the closure strip could have its flange 34 and 36 supported in the first groove means 14 and the closure strip would function as a fire stop. The tab 38 will need to be field bent slightly to assist in the mounting of the strip in the first groove means 14. The closure strip would, in effect, close off the openings 28 and 30 by being in its position shown in FIG. 4, and thus form a fire stop between the plenum area and the room below the ceiling. In addition, the closure strip could support between the top wall 8 and its body portion 32 appropriate insulation which would further function as a fire stop for the ceiling runner 2. The runner member is normally provided with white flanges 10 and 12, and the interior of the runner is normally painted black. Naturally, the runner member would have to be provided with appropriate black and white coats so that the closure strip would have a white side facing out when it is used in the FIG. 3 embodiment, but a black side facing out when it is used in the FIG. 4 embodiment.

What is claimed is:

1. In combination: a ceiling runner having an elongated sheet metal body with a generally inverted U-shaped configuration, said runner having two side walls connected together at their one ends with a flat top member, the opposite sides of the side walls having horizontal flanges which extend outwardly from the body of the runner to support ceiling boards on either side of the runner, said side walls having a groove means in the side walls closely positioned to the horizontal flanges forming a projection extending outwardly from the side walls of the runner adjacent said horizontal flanges; and, a closure strip means having a flat elongated body portion and flanges on the sides of the body portion, said flanges being in the form of two offset leg means positioned on one side of the plane containing the body portion, said closure strip means being sized to have its flanges positioned in said groove means and, at the same time, partly conform in shape to the flat top member and part of the side walls of the runner.

2. The combination of claim 1 wherein said body portion width is equal to the width of the top member which is also equal to the width between said side walls ends adjacent said horizontal flanges, and said offset leg means are a first leg connected to said body portion, said first leg extends outwardly from the body portion at an obtuse angle, and a second leg extending from said first leg at a right angle thereto.

3. The combination of claim 2 wherein said closure strip means has its flanges positioned in said groove means and said body portion thereof is in the same plane as said horizontal flanges.

4. The combination of claim 2 wherein said closure strip means has its flanges positioned in said groove means and said body portion thereof is not in the same plane as said horizontal flanges, but is positioned within the U-shaped configuration of said runner.

5. The combination of claim 2 wherein said flat top member has openings therein and closure strip means is positioned against said flat top member so that the body portion of said closure strip means closes over the openings in said flat top member.

6. The combination of claim 2 wherein said side walls have a second groove means at the mid-region thereof and said closure strip means has its flanges positioned in said second groove means so that said closure strip means is positioned well within the U-shaped configuration of said runner.

* * * * *